US008127708B2

(12) United States Patent
Hertzfeld et al.

(10) Patent No.: US 8,127,708 B2
(45) Date of Patent: Mar. 6, 2012

(54) MULTI-PAGE BOOKMARK

(76) Inventors: Leslie Kay Hertzfeld, Grand Rapids, OH (US); Angela Michelle Hall, Whitehouse, OH (US)

( * ) Notice: Subject to any disclaimer, the term of this patent is extended or adjusted under 35 U.S.C. 154(b) by 127 days.

(21) Appl. No.: 12/556,703

(22) Filed: Sep. 10, 2009

(65) Prior Publication Data

US 2010/0058975 A1 Mar. 11, 2010

Related U.S. Application Data

(60) Provisional application No. 61/096,089, filed on Sep. 11, 2008.

(51) Int. Cl.
*B42D 9/00* (2006.01)

(52) U.S. Cl. ..... 116/239; 116/234

(58) Field of Classification Search ..... 116/234–239; 281/42

See application file for complete search history.

(56) References Cited

U.S. PATENT DOCUMENTS

| | | | | | |
|---|---|---|---|---|---|
| 1,056,322 | A | * | 3/1913 | Carson | 116/238 |
| 1,322,796 | A | | 11/1919 | Kissel | |
| 1,346,856 | A | * | 7/1920 | Sprague | 116/239 |
| 2,394,372 | A | | 2/1946 | Evans | |
| 2,645,197 | A | | 7/1953 | Jones et al. | |
| 3,020,876 | A | * | 2/1962 | Riden | 116/238 |
| 3,059,609 | A | | 10/1962 | Sealana | |
| 3,898,951 | A | | 8/1975 | Clare | |
| 4,505,219 | A | | 3/1985 | Mangano | |
| D314,589 | S | | 2/1991 | Cooley | |
| D380,776 | S | | 7/1997 | Boshart | |
| D384,373 | S | | 9/1997 | Wong | |
| 6,109,204 | A | * | 8/2000 | Hoey et al. | 116/234 |
| 6,205,947 | B1 | | 3/2001 | Drew | |
| D453,185 | S | | 1/2002 | Kehrlein | |
| 6,401,649 | B1 | * | 6/2002 | Smith | 116/234 |
| 6,446,803 | B1 | * | 9/2002 | McKinney | 206/371 |
| D467,611 | S | | 12/2002 | Kim | |
| 6,895,888 | B1 | * | 5/2005 | Spillman | 116/238 |
| D519,560 | S | | 4/2006 | Roewe | |
| D534,584 | S | | 1/2007 | Goldberg et al. | |
| 7,823,528 | B2 | * | 11/2010 | Stevens | 116/234 |
| 2002/0158462 | A1 | | 10/2002 | Antoine | |
| 2005/0225074 | A1 | | 10/2005 | Goldberg et al. | |
| 2007/0245948 | A1 | * | 10/2007 | Paulin | 116/239 |
| 2008/0018092 | A1 | * | 1/2008 | Zeller et al. | 281/42 |
| 2008/0245290 | A1 | * | 10/2008 | Kang | 116/239 |

* cited by examiner

*Primary Examiner* — R. A. Smith

(74) *Attorney, Agent, or Firm* — Fraser Clemens Martin & Miller LLC; J. Douglas Miller

(57) ABSTRACT

A multi-page bookmark is disclosed. The multi-page bookmark includes straps adapted to form loops removably received around the front cover and the rear cover of a book, respectively. The loops are positioned adjacent the binding of the book. A connecting member is disposed between the loops adjacent an upper end of the book. The connecting member spans the book binding and is adapted to have at least one elongate book marking ribbon attached thereto which extend from the connecting member, wrap the upper end of the binding of the book, and may be received between selected pages of the book.

9 Claims, 3 Drawing Sheets

MULTI-PAGE BOOKMARK

CROSS-REFERENCE TO RELATED APPLICATION

This application claims the benefit of U.S. Pat. Appl. No. 61/096,089 filed Sep. 11, 2008, hereby incorporated herein by reference in its entirety.

FIELD OF THE INVENTION

The invention relates to a bookmark, and more specifically to a bookmark adapted to mark multiple page locations within a book.

BACKGROUND OF THE INVENTION

Bookmarks are well known simple devices employed by a reader to mark a desired page within a book. Previous bookmarks have typically included one of three general types. One type consists of a bookmark removably disposed between pages of a book as illustrated in U.S. Design Pat. Nos. D384,373 and D467,611, for example. A second type may be a clip that is removably attached to one or more pages of the book as illustrated in U.S. Design Pat. No. D519,560. A third type is a device that may be attached to a binding of the book and includes one or more page marking members such as ribbons attached thereto as illustrated in U.S. Pat. Nos. 2,645,197 and 3,059,609, for example.

Although these general types of bookmarks can mark a desired page in a book, each has limitations. For example, the first type can easily slide between pages making it difficult for the reader to locate the bookmark; the second type can damage a page to which it is attached; and the third type requires a specific style of binding for attachment to the book and cannot be effectively employed with a paperback book.

It would be desirable to have a bookmark for use with both hard cover and paperback books that can be readily attached to and removed from a book, and is adapted to mark multiple page locations within the book.

SUMMARY OF THE INVENTION

A bookmark for use with both hard cover and paperback books that can be readily attached to and removed from a book, and can readily mark multiple page locations within the book has surprisingly been discovered.

The above objective, as well as others, may be achieved by a multi-page bookmark comprising two straps adapted to be removably received around a front cover and a rear cover of a book, respectively; a connecting member disposed between the pair of straps adapted to span the book binding; and at least one elongate book marking ribbon attached to the connecting member.

BRIEF DESCRIPTION OF THE DRAWINGS

The above, as well as other objects and advantages of the invention, will become readily apparent to those skilled in the art from the following detailed description of an embodiment of the invention when considered in the light of the accompanying figure, in which.

DETAILED DESCRIPTION OF A PREFERRED EMBODIMENT OF THE INVENTION

The following detailed description and appended drawings describe and illustrate various exemplary embodiments of the invention. The description and drawings serve to enable one skilled in the art to make and use the invention, and are not intended to limit the scope of the invention in any manner.

Figure 1:
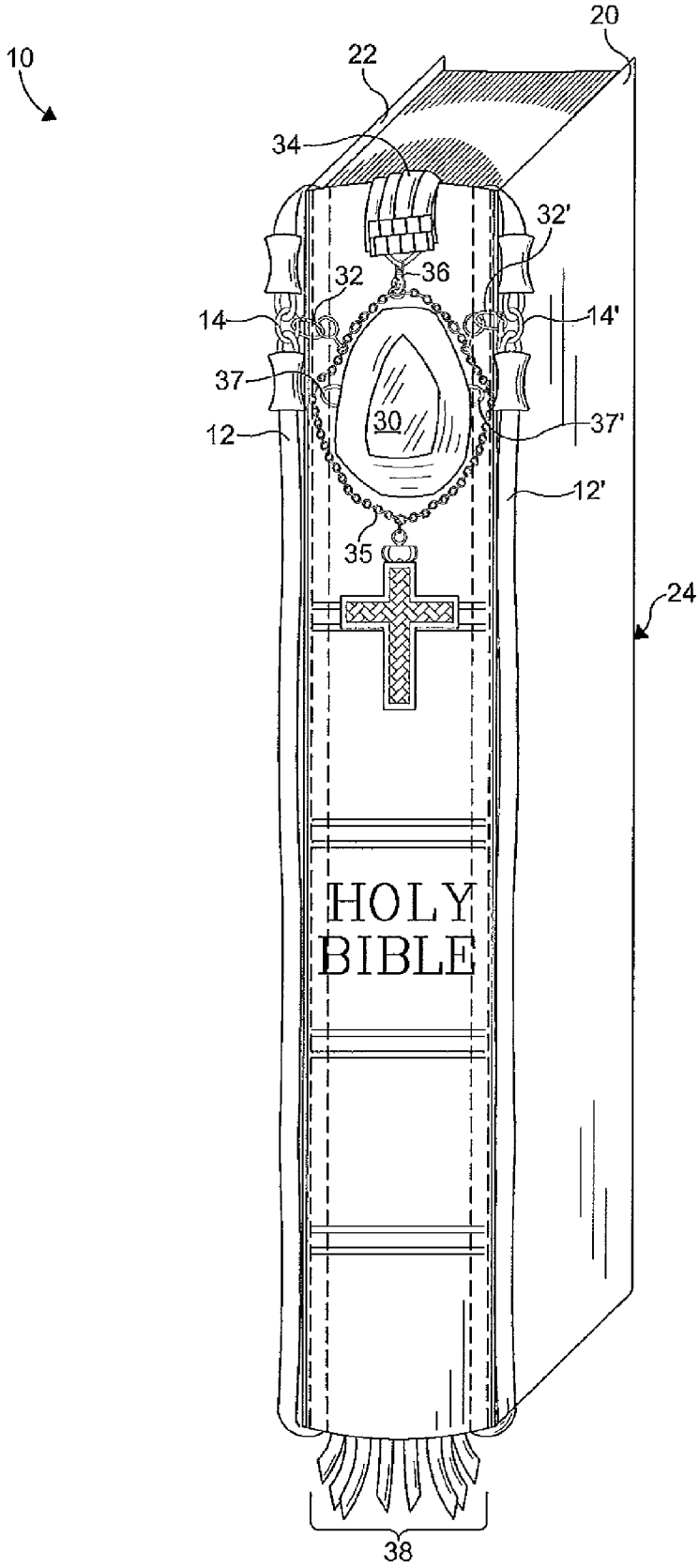
FIG. 1 is a view of the back of a conventionally bound book with a multi-page bookmark according to an embodiment of the invention.
Figure 2:
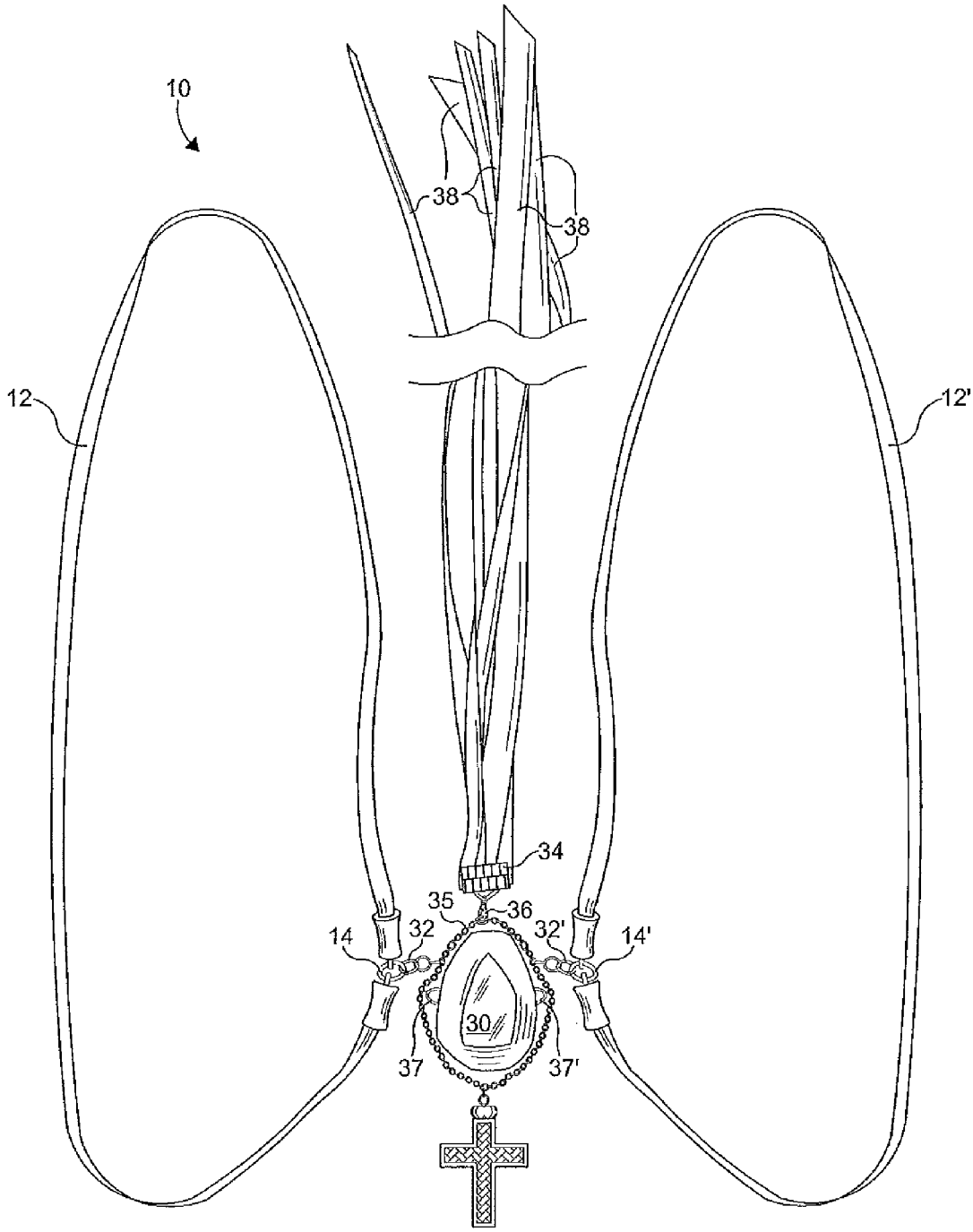
FIG. 2 is a plan view of the multi-page bookmark illustrated in FIG. 1.
Figure 3:
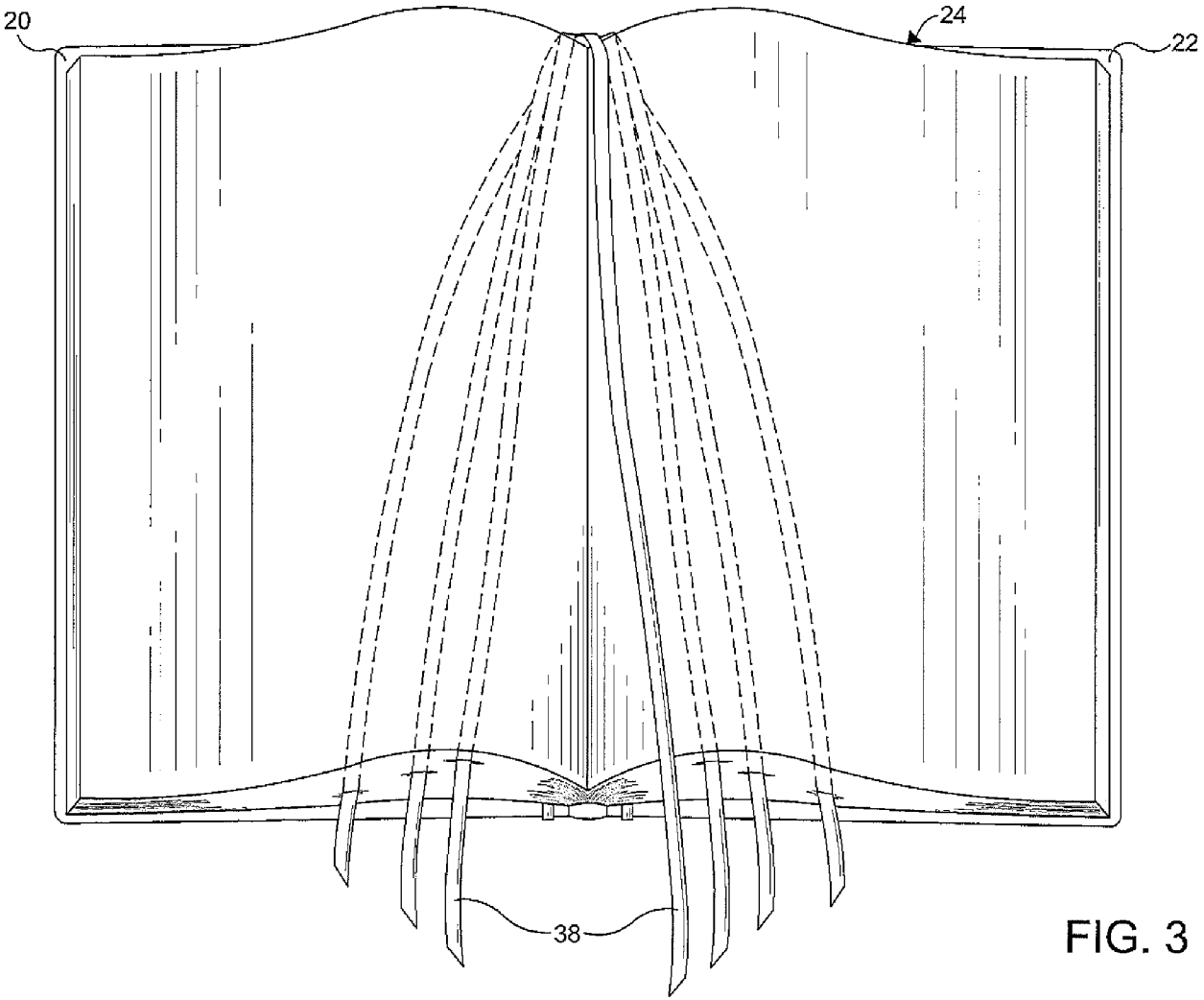
FIG. 3 is a perspective view of the book illustrated in FIG. 1 in open position showing the bookmark illustrated in FIGS. 1 and 1 in use.

Referring to FIGS. 1-3 there is illustrated a multi-page bookmark 10. The bookmark 10 includes a pair of substantially identical straps 12 and 12' since the straps 12 and 12' are substantially identical, corresponding similar components will be designated as primes (‘). Each end of the straps 12 and 12' includes a clasp adapted to be connected to a respective lock ring 14 and 14'. The clasps and lock rings 14 and 14' cooperate to join the ends of the respective straps 12 and 12' and form loops that are adapted to be removably received around the front cover 20 and the back cover 22 of a book 24, respectively. The straps 12 and 12' may be formed from a braided cord material, elastomeric material, cable, chain, ribbon, or any other suitable material or a combination thereof. The straps 12 and 12' can be selected to form the respective loops to fit a particular size book, or a range of sizes of books. The straps 12 and 12' may be adjustable to form loops to fit a wide range of sizes of books.

A centrally disposed member 30 is provided to interconnect the straps 12 and 12' through suitable linkages 32 and 32' which typically include chain member attachable to a chain member 35. The chain member 35 is adapted to be attached to the connecting member 30 by connecting linkages 37 and 37'.

At least one book marking member 34 is attached to the chain member 35 of the member 30. In the illustrated embodiment, the book marking member 34 includes a plurality of longitudinally extending ribbons 38 formed from a ribbon material secured in a clasp 36 adapted to be attached to the member 30. It should be understood that a plurality of clasps 38, each clasp including book marking members 34, can be attached to the member 30. The elongate book marking members 34 may be formed from strips of flexible material, an elastomeric material, a chain, or any other suitable material or a combination thereof, for example.

Other items may also be attached to the member 30 such as a crucifix, charms, or the like. The member 30 may typically be decorative in nature or may contain indica containing a message, for example.

In use, the multi-page bookmark 10 is employed to enable a reader of the book 24 to mark the location of multiple pages within the book 24. The reader places the straps 12 and 12' around the front cover 20 and the back cover 22, respectively, of the book 24 to secure the bookmark 10 thereto. The loops are positional adjacent the binding of the book 24 as clearly illustrated in FIG. 1. The connecting member 20 is disposed between the straps 12 and 12'. The connecting member 20 spans the width of the binding of the book 24 and is typically located at an upper end of the book 24 as illustrated in FIG. 1.

The book marking member 34 is attached to the connecting member 30 by a clasp 36. The ribbons 38 extend around the upper end of the binding of the book 24 and are received between selected pages of the book 24.

The bookmark 10 may be readily used with hard cover and paperback books. The connecting member 30 and the ribbons 38 of the book marking member 34 cooperate to enable a reader to mark multiple page locations within a book. More specifically, the ribbons 38 are interdigitated between adjacent pages of the book 24. Obviously, the number of simultaneous markings is a function of the number of ribbons.

The clasps used in interconnecting the various elements of the bookmark 10 may be of a variety of types. It has been found that the clasps having a spring actuated closure member of the type typically used in jewelry field have functioned satisfactorily.

The overall appearance of the bookmark 10 may be modified by attaching selected charms and other decorative accessories to the chain 35 of the connecting member 30, and by changing the decorative portion of the connecting member 30. The bookmark 10 has been found to be particular useful for use with books such as text books, Bibles, and the like where a reader of the book desires to mark multiple page locations that include key information or favorite passages, for example.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A multi-page bookmark for selective attachment to a book having a front and a rear cover connected by a binding comprising:

a plurality of spaced apart straps, each of the straps including a first end connected to a second end to form a loop adapted to be removably received on a front cover and a back cover of a book;

a member connecting the straps disposed entirely between the straps, wherein the member connecting the straps spans across an intermediate portion of the book binding; and a plurality of elongate book marking ribbons attached to the member connecting the straps at a single connection point.

2. The bookmark defined in claim 1 wherein the member connecting the straps includes a flexible linkage.

3. The bookmark defined in claim 2 wherein the flexible linkage is a chain.

4. The bookmark defined in claim 1 whereas the straps are connected to the member by independently actuated clasps.

5. The bookmark defined in claim 4 wherein the clasps include spring actuated closures.

6. The bookmark as defined in claim 1 wherein the member connecting the straps includes decorative indicia.

7. The bookmark as defined in claim 6 wherein the member connecting the straps includes an outer marginal edge.

8. The bookmark as defined in claim 7 including a chain attached to and surrounding the marginal edge of the member connecting the straps.

9. The bookmark defined in claim 1 wherein a length of the straps is adjustable.

* * * * *